US007374046B1

(12) United States Patent
O'Brien

(10) Patent No.: US 7,374,046 B1
(45) Date of Patent: May 20, 2008

(54) DISPOSABLE FOOD DELIVERY APPARATUS

(76) Inventor: John J. O'Brien, One Potato Pl., Winnemucca, NV (US) 89445

( * ) Notice: Subject to any disclaimer, the term of this patent is extended or adjusted under 35 U.S.C. 154(b) by 0 days.

(21) Appl. No.: 10/919,793

(22) Filed: Aug. 16, 2004

Related U.S. Application Data

(62) Division of application No. 10/080,283, filed on Feb. 20, 2002, now Pat. No. 6,802,423.

(51) Int. Cl.
*A45C 11/20* (2006.01)
*B65D 77/00* (2006.01)

(52) U.S. Cl. ..... 206/541; 206/216; 222/192; 426/115; 424/400

(58) Field of Classification Search ..... 206/541 X, 206/216 X, 546, 542; 222/192 X, 212; 426/115 X; 424/400 X, 486; 215/389, 390, 391
See application file for complete search history.

(56) References Cited

U.S. PATENT DOCUMENTS

| | | | | | |
|---|---|---|---|---|---|
| 2,252,119 | A | * | 8/1941 | Edmonds | 30/123.3 |
| 2,685,316 | A | * | 8/1954 | Krasno | 206/524.8 |
| 3,116,152 | A | | 12/1963 | Smith | |
| 3,133,679 | A | * | 5/1964 | Brown | 222/205 |
| 3,259,132 | A | * | 7/1966 | Katter | 30/324 |
| 3,383,018 | A | * | 5/1968 | Grimsley | 222/108 |
| 3,833,154 | A | | 9/1974 | Markowitz | |
| 3,834,570 | A | | 9/1974 | Barr | |
| 4,091,965 | A | | 5/1978 | Gebhard | |
| 4,803,088 | A | | 2/1989 | Yamamoto et al. | |
| 4,875,508 | A | | 10/1989 | Burke et al. | |
| 4,966,312 | A | | 10/1990 | Waring | |
| 5,054,631 | A | * | 10/1991 | Robbins, III | 215/389 |
| 5,137,183 | A | | 8/1992 | Mikulec et al. | |
| 5,305,928 | A | | 4/1994 | Verdaguer | |
| 5,332,121 | A | | 7/1994 | Schmidt et al. | |
| 5,361,918 | A | | 11/1994 | Mason | |
| 5,421,485 | A | | 6/1995 | Furuta et al. | |
| 5,556,008 | A | * | 9/1996 | Silver et al. | 222/192 |
| 5,682,931 | A | | 11/1997 | Mouchmouchian | |
| 5,705,212 | A | | 1/1998 | Atkinson | |
| D397,933 | S | | 9/1998 | Mazda | |
| 5,881,926 | A | | 3/1999 | Ross | |
| 5,983,965 | A | | 11/1999 | Patrick | |
| 6,102,254 | A | | 8/2000 | Ross | |
| 6,170,712 | B1 | | 1/2001 | Kasboske | |
| 6,223,932 | B1 | | 5/2002 | Usui | |
| 6,399,079 | B1 | * | 6/2002 | Mehta et al. | 424/400 |

* cited by examiner

*Primary Examiner*—Jila M Mohandesi
(74) *Attorney, Agent, or Firm*—Clayton, Howarth & Cannon, P.C.

(57) ABSTRACT

A disposable food delivery device is disclosed. The device includes a food utensil coupled to a food container. The food container can be pre-charged with food, such as a dehydrated food, such that a liquid can be added to the dehydrated food to result in a ready-to-eat food at any selected time. The food container illustratively can include a port for receiving the liquid. The food container also illustratively can include a security seal for assuring that the food has not been contaminated prior to consumption. Another illustrative embodiment of the invention includes a valve for retaining liquid in the food container prior to consumption of the food.

17 Claims, 12 Drawing Sheets

DISPOSABLE FOOD DELIVERY APPARATUS

CROSS-REFERENCE TO RELATED APPLICATIONS

This application is a division of U.S. application Ser. No. 10/080,283, filed Feb. 20, 2002, now U.S. Pat. No. 6,802, 423, which is hereby incorporated in its entirety.

STATEMENT REGARDING FEDERALLY SPONSORED RESEARCH OR DEVELOPMENT

Not applicable.

BACKGROUND OF THE INVENTION

This invention relates to a disposable food delivery apparatus. More particularly, this invention relates to a disposable food delivery apparatus comprising a food container coupled to a food utensil member. In an illustrative embodiment of the invention, the food container is pre-charged with food, such as a dehydrated food that can be rehydrated with water in the food container such that dehydrated food is rendered ready to eat. In such an illustrative embodiment, the food container illustratively comprises a port for receiving the water therein. In another illustrative embodiment of the invention, the food container comprises a security seal for assuring that the food has not been contaminated prior to consumption. In still another illustrative embodiment of the invention, the food container comprises a valve for retaining liquids in the food container until the food is ready for consumption.

In recent years, foods that are ready to eat or that can be prepared quickly and with a minimum of effort have become a growing part of the American diet. So-called "fast foods" are increasingly popular, but often are high in calories, high in fat, and low in nutritional quality. It will be appreciated that providing a food delivery device that provides for quick and easy preparation of healthy, nutritious food would be a significant advancement in the art.

BRIEF SUMMARY OF THE INVENTION

A disposable food delivery device is disclosed. The device includes a food utensil disposed on a food container. The food container can be pre-charged with food, such as a dehydrated food, such that a liquid can be added to the dehydrated food to result in a ready-to-eat food at any selected time. The device includes a channel for conducting the food from the food container into the food utensil, where it is available for consumption. The food container or food utensil can illustratively can include a port for receiving the liquid to be added to the dehydrated food. The food container also illustratively can include a security seal for assuring that the food has not been contaminated prior to consumption. Another illustrative embodiment of the invention includes a valve for retaining liquid in the food container prior to consumption of the food.

DETAILED DESCRIPTION

Figure 1:
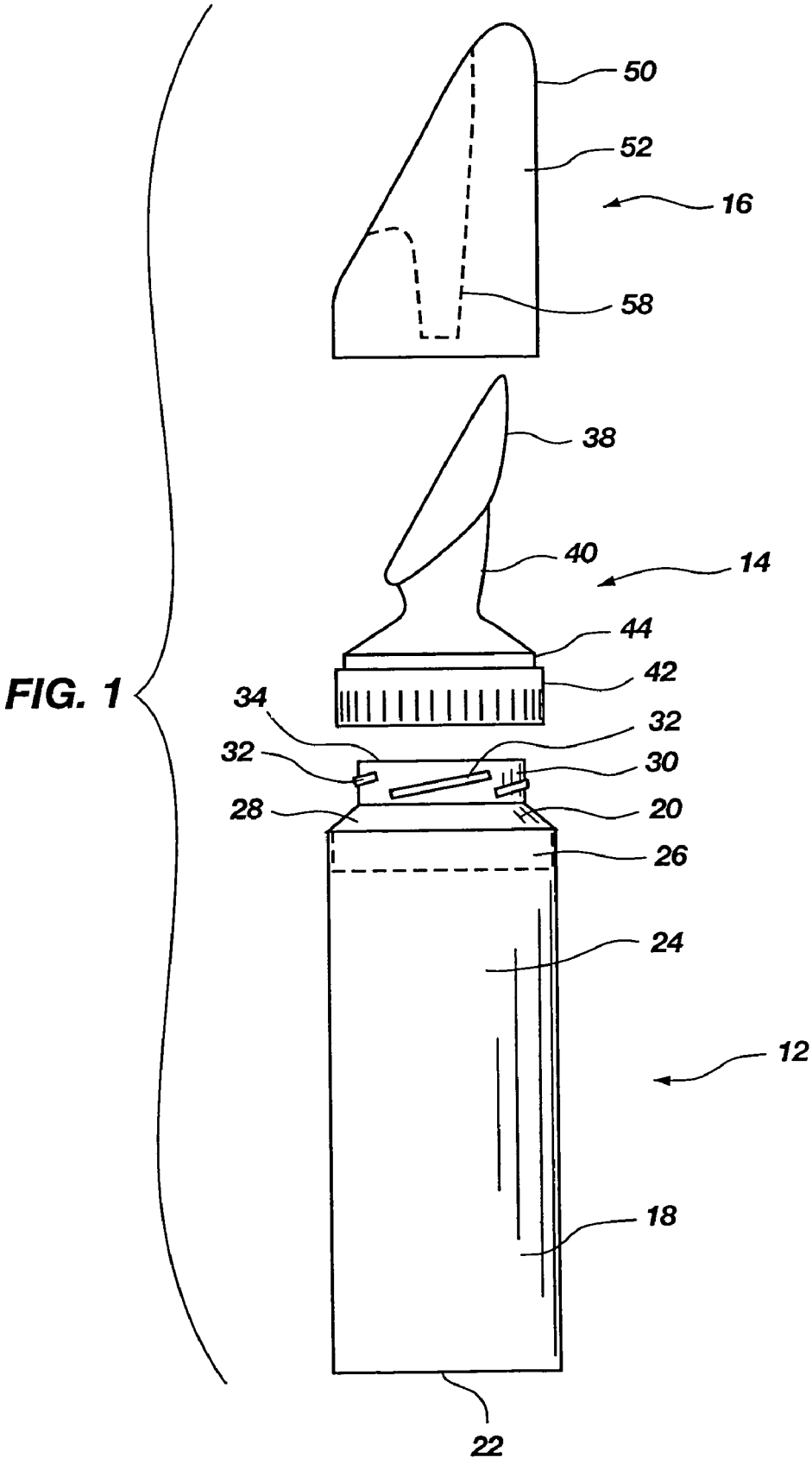
FIG. 1 shows an exploded side elevation view of an illustrative food delivery apparatus according to the present invention.
Figure 2:
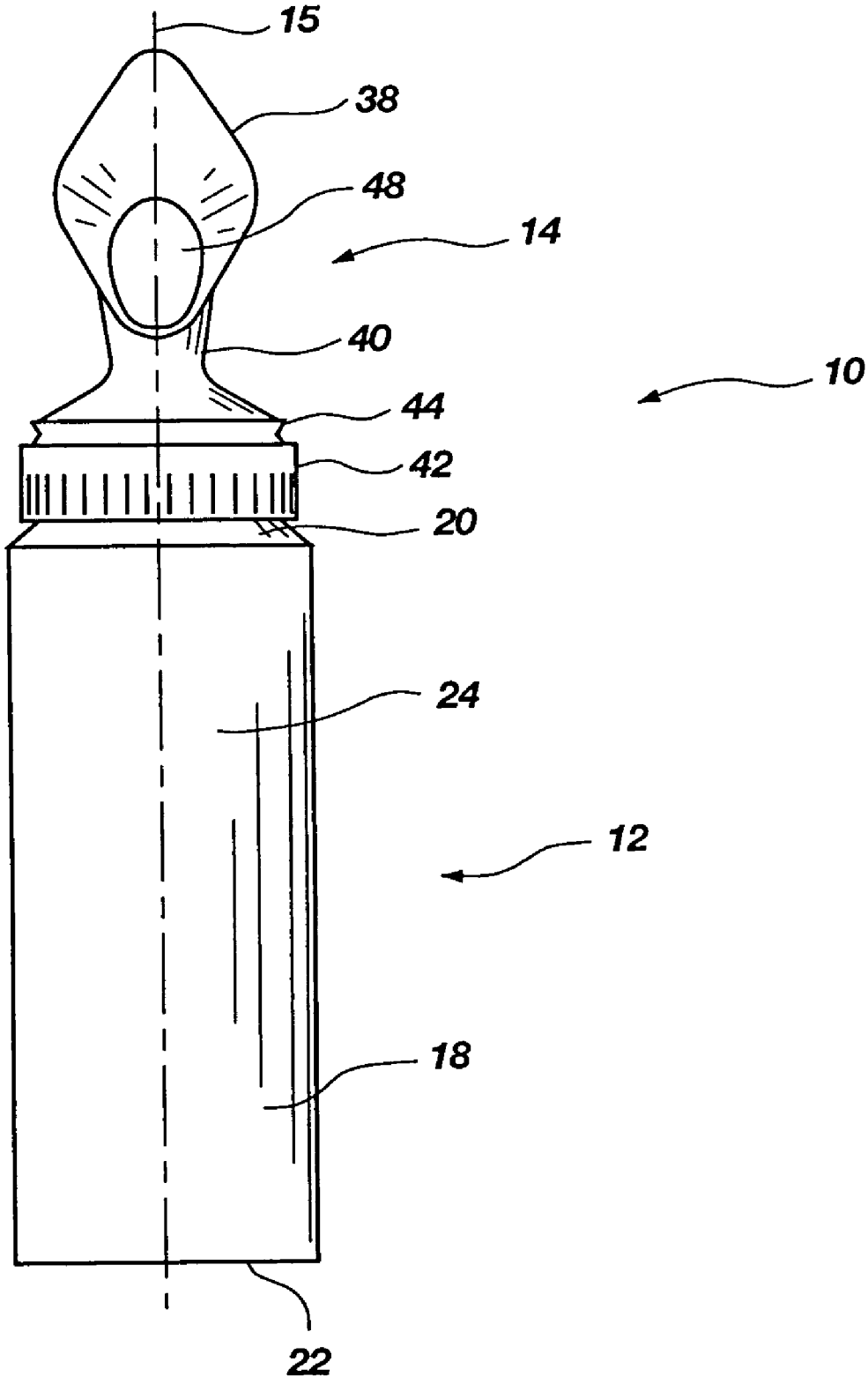
FIG. 2 shows a front elevation view of the food delivery apparatus of FIG. 1 without the cap.
Figure 3:
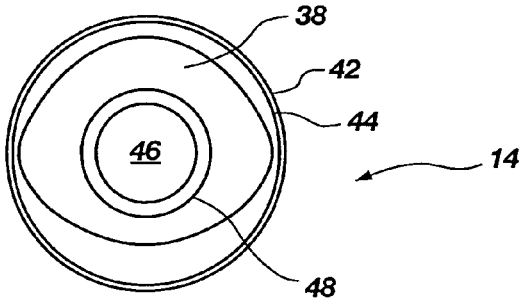
FIG. 3 shows a top view of the food utensil portion of the food delivery apparatus of FIG. 1.

Before the present disposable food delivery apparatus and methods of making and using thereof are disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice are hereby incorporated by reference. The references discussed herein are provided solely for their disclosure prior to the filing date of the present application. Nothing herein is to be construed as an admission that the inventors are not entitled to antedate such disclosure by virtue of prior invention.

It must be noted that, as used in this specification and the appended claims, the singular forms "a," "an," and "the" include plural referents unless the context clearly dictates otherwise. Thus, for example, reference to disposable food delivery apparatus containing "a port" includes reference to an apparatus containing two or more of such ports, reference to "a utensil" includes reference to one or more of such utensils, and reference to "a valve" includes reference to two or more of such valves.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

FIGS. 1-6 show an illustrative food delivery apparatus according to the present invention. The food delivery apparatus 10 comprises a food container 12, a food utensil 14, and a cap 16. The food container comprises a flexible bag 18 and a collar 20. The flexible bag 18 is disposed on the collar 20 such that there is no leakage of liquid or semi-liquid food therebetween. The flexible bag 18 can be attached to the collar 20 by heat sealing, use of an appropriate adhesive, or the like, according to methods well known in the art. In an illustrative embodiment of the invention, the flexible bag is made of a flexible plastic material, such as polyethylene, polypropylene, or other suitable polymers. The flexible bag is sealed at the bottom 22 thereof, such as by heat sealing, thereby forming a vessel 24 for holding food.

The collar 20 comprises a lower portion 26 (shown in phantom in FIG. 1) to which the flexible bag 18 is attached, a middle portion 28 coupled to the lower portion 26, and a neck 30 coupled to the middle portion 28. The neck 30 comprises a plurality of ridges 32 for use in releasably attaching the food container 12 to the food utensil 14. This releasable attachment will be described in more detail below.

In an illustrative embodiment of the invention, the collar further comprises an opening 34 through which the food in the food container 12 can pass from the food container 12 to the food utensil 14. In an illustrative embodiment of the invention, this opening 34 is sealed with a seal 36 after placing a food, such as a dehydrated food, in the food container 12 at the factory. This seal prevents the entry of moisture or contaminants from contacting the food until the seal is removed by the consumer just prior to use.

In an illustrative embodiment of the food delivery apparatus 10, the food utensil 14 comprises a bowl 38 disposed on a funnel member 40, which is in turn disposed on a ring member 42. The lower edge of the funnel member 40 comprises a rim 44. This rim 44 is configured for cooperatively engaging the inner surface of the cap 16 for holding the cap 16 in place over the bowl 38 and funnel member 40, as will be described in more detail below. The funnel member 40 comprises a channel 46 for receiving food from the food container 12 and channeling it to the bowl 38. The channel 46 ends at an opening 48 in the bowl 38. Thus, food that is channeled through the channel 46 enters the bowl 38 through the opening 48. Once the food is in the bowl 38, it is ready to be eaten by the consumer.

Figure 4:
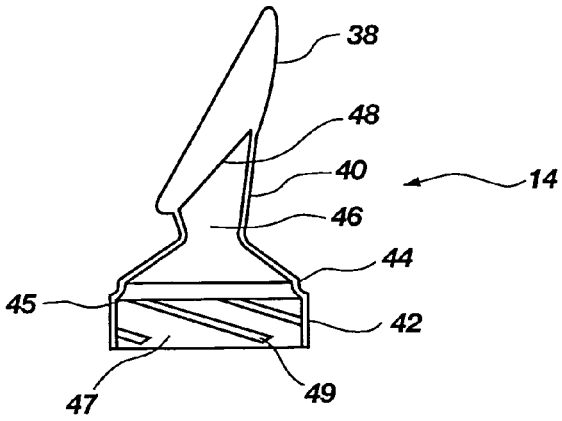
FIG. 4 shows a sectional view along line 15 of the food utensil portion of the food delivery apparatus of FIG. 1.
Figure 5:
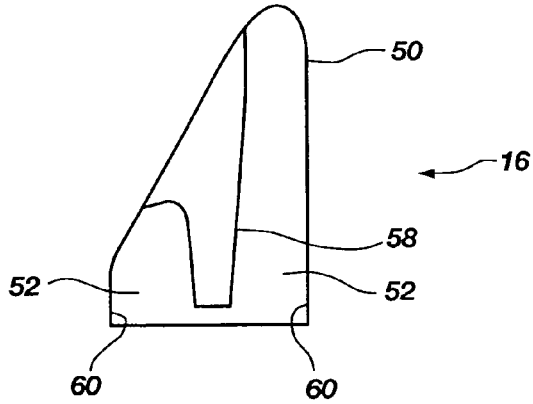
FIG. 5 shows side sectional view of the cap of the food delivery apparatus of FIG. 1.
Figure 6:
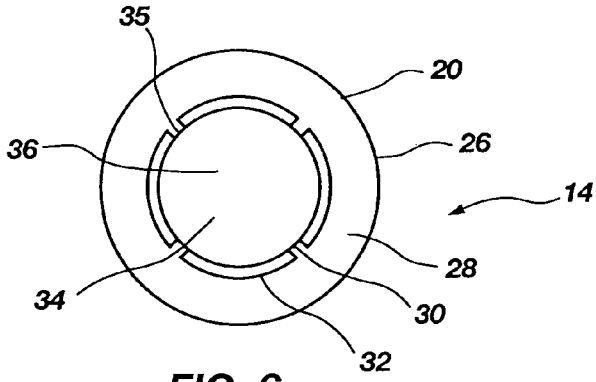
FIG. 6 shows a top view of the food container portion of the food delivery apparatus of FIG. 1.
Figure 7:
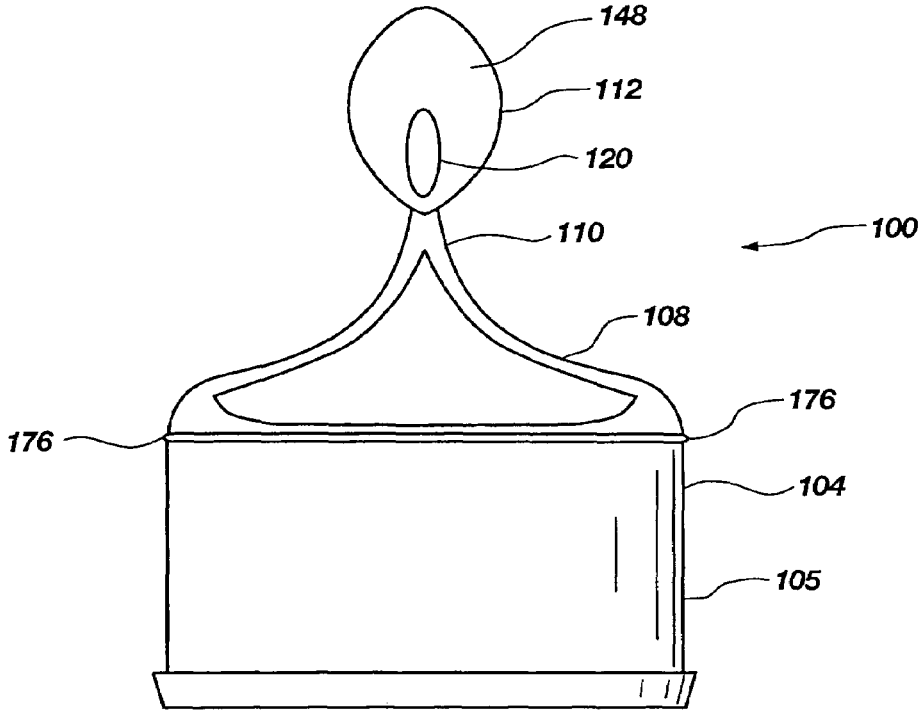
FIG. 7 shows a front elevation view of an illustrative food delivery apparatus according to the present invention.
Figure 8:
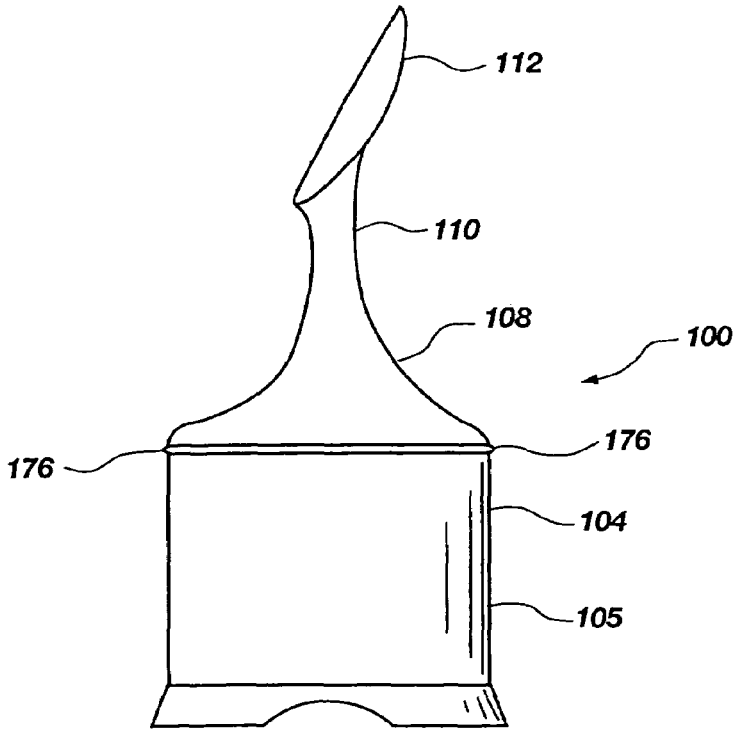
FIG. 8 shows a side elevation view of the food delivery apparatus of FIG. 7.
Figure 9:
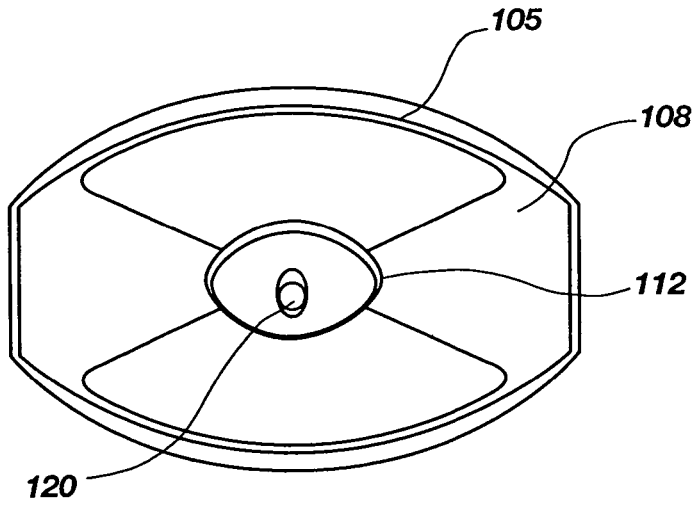
FIG. 9 shows a top view of the food delivery apparatus of FIG. 7.
Figure 15:
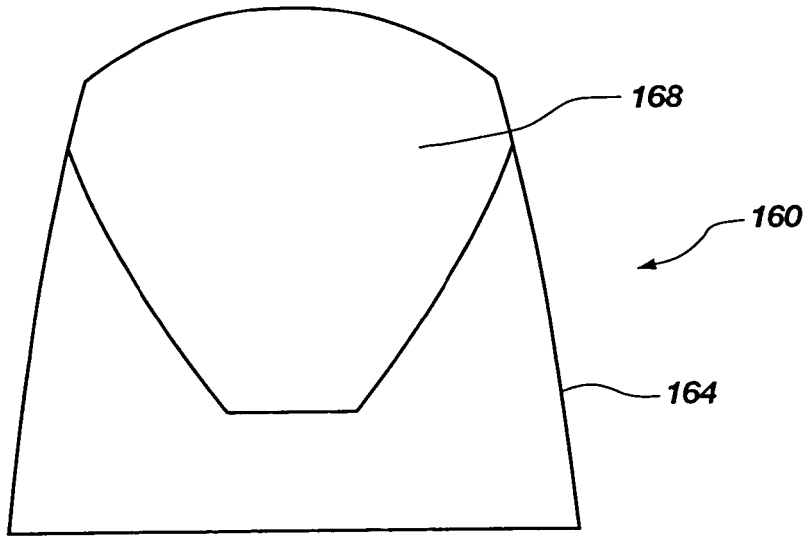
FIG. 15 shows a front elevation view of a cap for use with the food delivery apparatus of FIG. 7.
Figure 10:
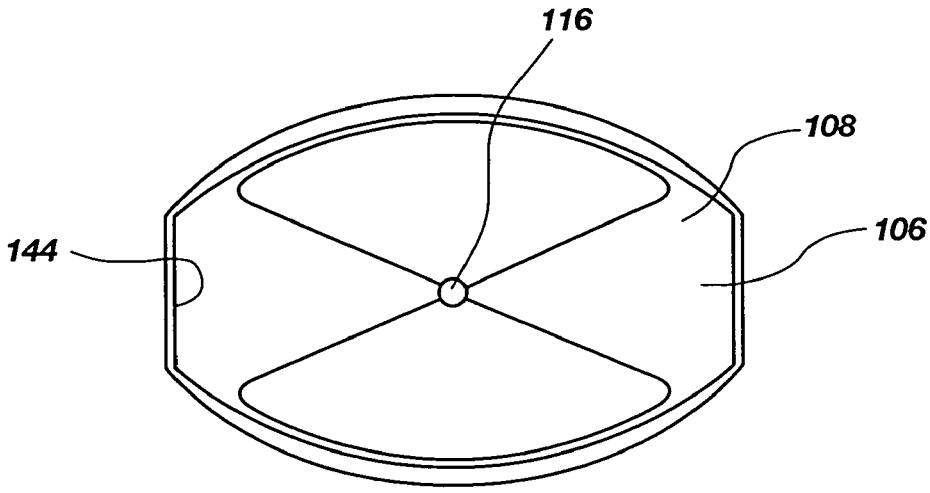
FIG. 10 shows a bottom view of the food delivery apparatus of FIG. 7.
Figure 16:
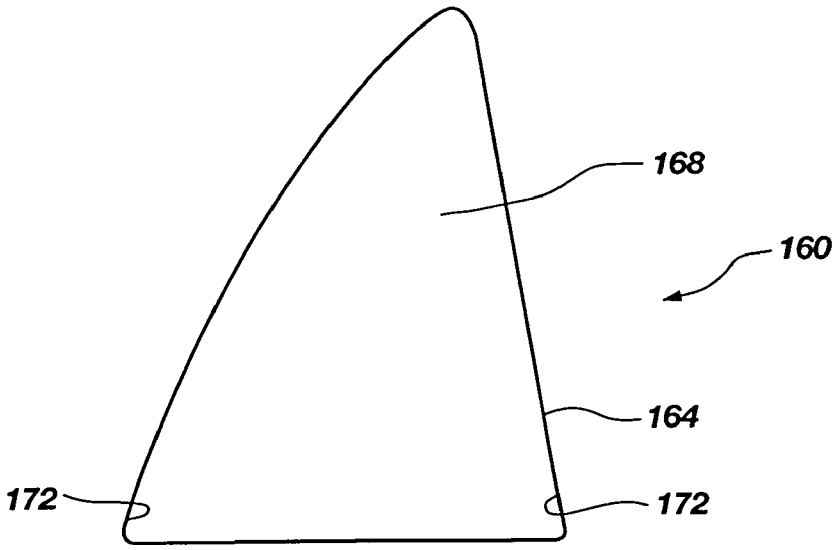
FIG. 16 shows a side elevation view of the cap of FIG. 15.
Figure 11:
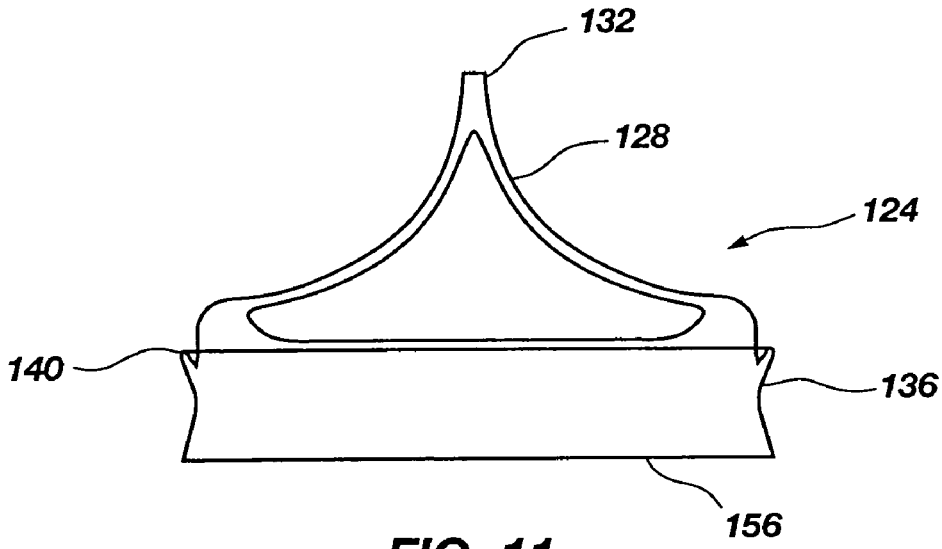
FIG. 11 shows a side elevation view of a plunger for use with the food delivery apparatus of FIG. 7.
Figure 12:
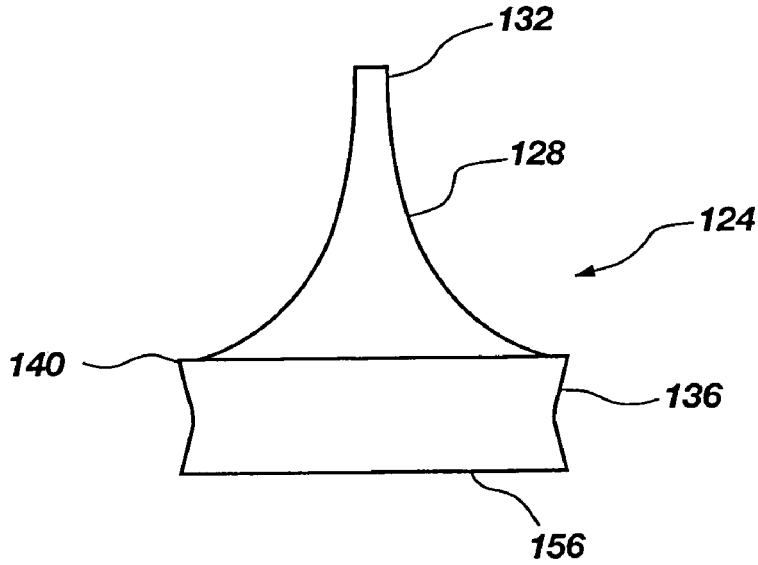
FIG. 12 shows a side view of the plunger of FIG. 11.
Figure 13:
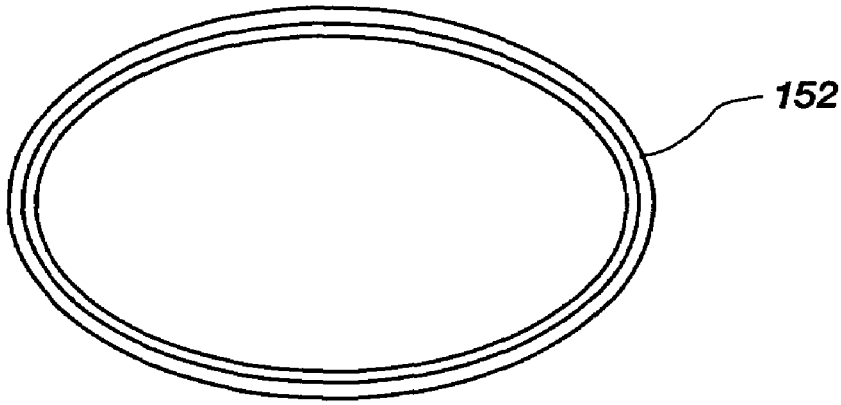
FIG. 13 shows a top view of a pressure plate for use with the food delivery apparatus of FIG. 1.
Figure 14:
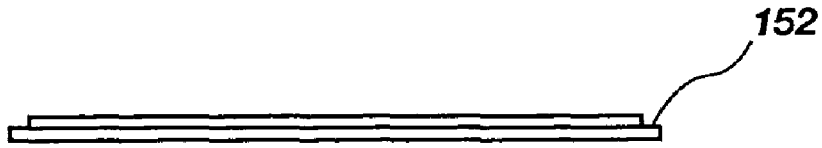
FIG. 14 shows a side view of the pressure plate of FIG. 13.

As shown in FIG. 4, the ring member 42 of the food utensil 14 comprises and inner wall 47 on which are disposed a plurality of ridges 49. These ridges 49 are configured to cooperatively engage the ridges 32 of the collar 20 such that the food utensil 14 can be attached to the collar 20 by twisting and tightening the food utensil 14 onto the collar 20, resulting in a leak-proof seal of the top edge 35 of the neck 30 against the inside rim 45 of the food utensil 14. Friction of the ridges 32 of the neck 30 against the inner ridges 49 of the food utensil 14 holds the top edge 35 against the inside rim 45.

The cap 16 comprises a housing 50 that defines a chamber 52. The housing 50 comprises a side wall 54 and a top 56 disposed thereon. Extending downward from the top 56 is a plug 58, which is configured for fitting into the channel 46 of the utensil when the cap 16 is in place over the bowl 38 and funnel member 40. The plug 58 closes the channel 46 for preventing food from passing therethrough. The lower end of the inner wall 60 of the cap 16 is configured for cooperatively engaging the rim 44 of the food utensil 14 such that the cap 16 is held in place by friction of the inner wall 60 against the rim 44.

As mentioned above, in an illustrative embodiment of the invention, food, such as instant mashed potatoes, is placed in the food container 12 in the factory, and a seal 36 is placed over the opening 34 of the neck 30 to seal the food inside the food container 12 to prevent contamination of the food with water or other contaminants. The food utensil 14 is twisted onto the neck 30 of the food container 12, and the cap 16 is placed on the food utensil 14 such that the plug 58 closes the channel 46 and the cap is held in place by the friction of the inner wall 60 against the rim 44. The consumer uses the food delivery apparatus 10 by untwisting the food utensil 14 from the food container 12, removing the seal 36, adding hot water to the food contained in the food container (if such food is dehydrated food), and replacing the food utensil 14. The food is rehydrated and mixed, if necessary, by manipulating the flexible bag 18 until mixing is complete. It will be appreciated that the plug 58 extending into the channel 46 prevents the food from passing through the channel 46 until the cap is removed. Next, the cap is removed and the flexible bag is squeezed, thus allowing the flowable food to pass out of the food container through the opening 34, through the funnel member 40, through the channel 46, and into the bowl 38 of the food utensil 14. Once the food is present in the bowl 38, the food utensil 14 functions as a spoon, and the consumer can eat the food. After the food is consumed, the food delivery apparatus 10 can be disposed of.

In an alternative embodiment of the food delivery apparatus of FIGS. 1-6, the bowl 38 can be replaced with a tubular, straw-like member. In this embodiment, the food passes through the channel and the tubular, straw-like member. The consumer can place the tubular, straw-like member in her mouth and receive the flowable food directly therefrom.

FIGS. 7-16 show another illustrative embodiment of a food delivery apparatus 100 according to the present invention. The food delivery apparatus 100 comprises a food container 104 for holding a flowable food. The food container comprises a side wall 105, which defines a chamber 106. A funnel member 108 is disposed on the upper end of the food container 104, comprising a neck 110. Disposed on the neck 110 is a food utensil 112. A channel 116 passes through the neck 110 to an opening 120.

The food delivery apparatus 100 further comprises a plunger 124 configured for fitting into the chamber 106. The plunger 124 comprises a plug 128 configured for fitting into the funnel member 108. The upper end 132 of the plug 128 is configured for being received into the channel 116, thereby plugging the channel 116 and preventing the passage of food therethrough. The plunger also comprises a side wall 136 having an upper edge 140 configured for contacting the inner wall 144 of the food container 104. The plunger 124 is configured to slide in the chamber 106 for pushing food contained in the chamber 106 through the funnel member 108, into the channel 116, and out through the opening 120 into the bowl 148 of the food utensil 112. The upper edge 140 illustratively slides with little play next to the inner wall 144 such that virtually all of the food is scraped from the inner wall 144 and pushed into the funnel member 108. A pressure plate 152 is conveniently disposed on the bottom edge 156 of the plunger 124. Pressure applied to the pressure plate 152 causes the plunger 124 to slide in the chamber 106, thereby pushing the food as described above.

Illustratively, the food delivery apparatus 100 further comprises a cap 160 comprising a wall 164 defining a cavity 168. The cap 160 is configured for fitting over the funnel member 108 and food utensil 112 for protecting them from contamination. An inner wall 172 of the cap 160 is configured for cooperatively associating with a rim 176 at an upper end of the side wall 105 of the food container 104. Friction of the rim 176 against the inner wall 172 causes the cap 160 to remain in place disposed over the funnel member 108 and the food utensil 112.

The food delivery apparatus 100 is used by placing a flowable food, such as mashed potatoes or pureed food, such as a baby food, in the chamber 106, placing the plunger 124 in the chamber 106 with the plug 128 toward the funnel member 108, placing the pressure plate 152 at the bottom edge 156 of the plunger 124, removing the cap 160, and them applying pressure to the pressure plate 152, thereby causing the plunger 124 to slide in the chamber 106 such that the food is pushed toward the funnel member 108. As the plunger 124 slides against the inner wall 144 of the food container 104, the upper edge 140 of the side wall 136 of the plunger scrapes any food adhering to the inner wall 144 and pushes it toward the funnel member 108, as well. Continued application of pressure pushes the food into the channel 116, and eventually the food exits the channel 116 at the opening 120 such that the food is delivered to the bowl 148 of the food utensil 112. The food is then available to be consumed.

Figure 17:
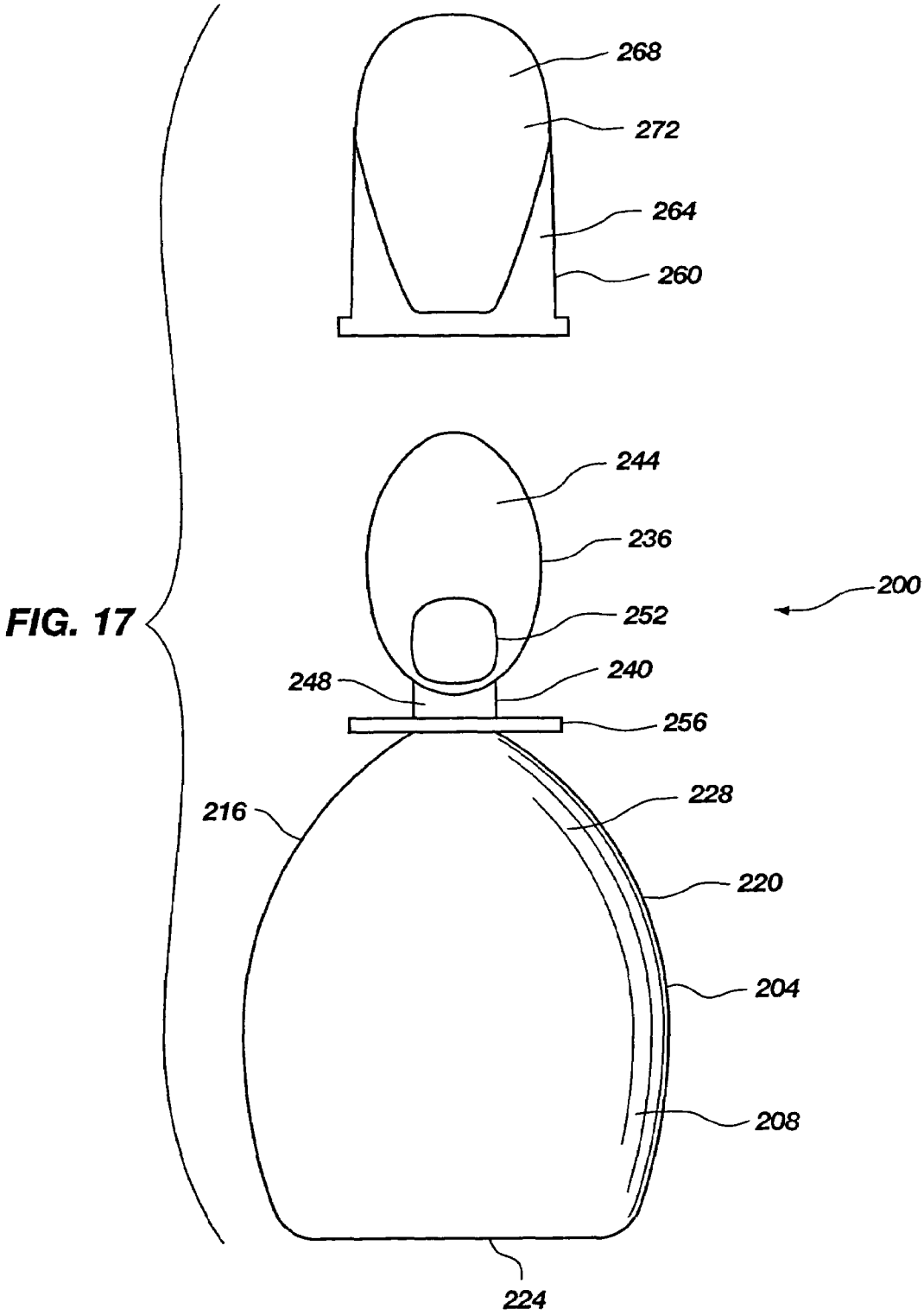
FIG. 17 shows an exploded front elevation view of an illustrative food delivery apparatus according to the present invention.
Figure 18:
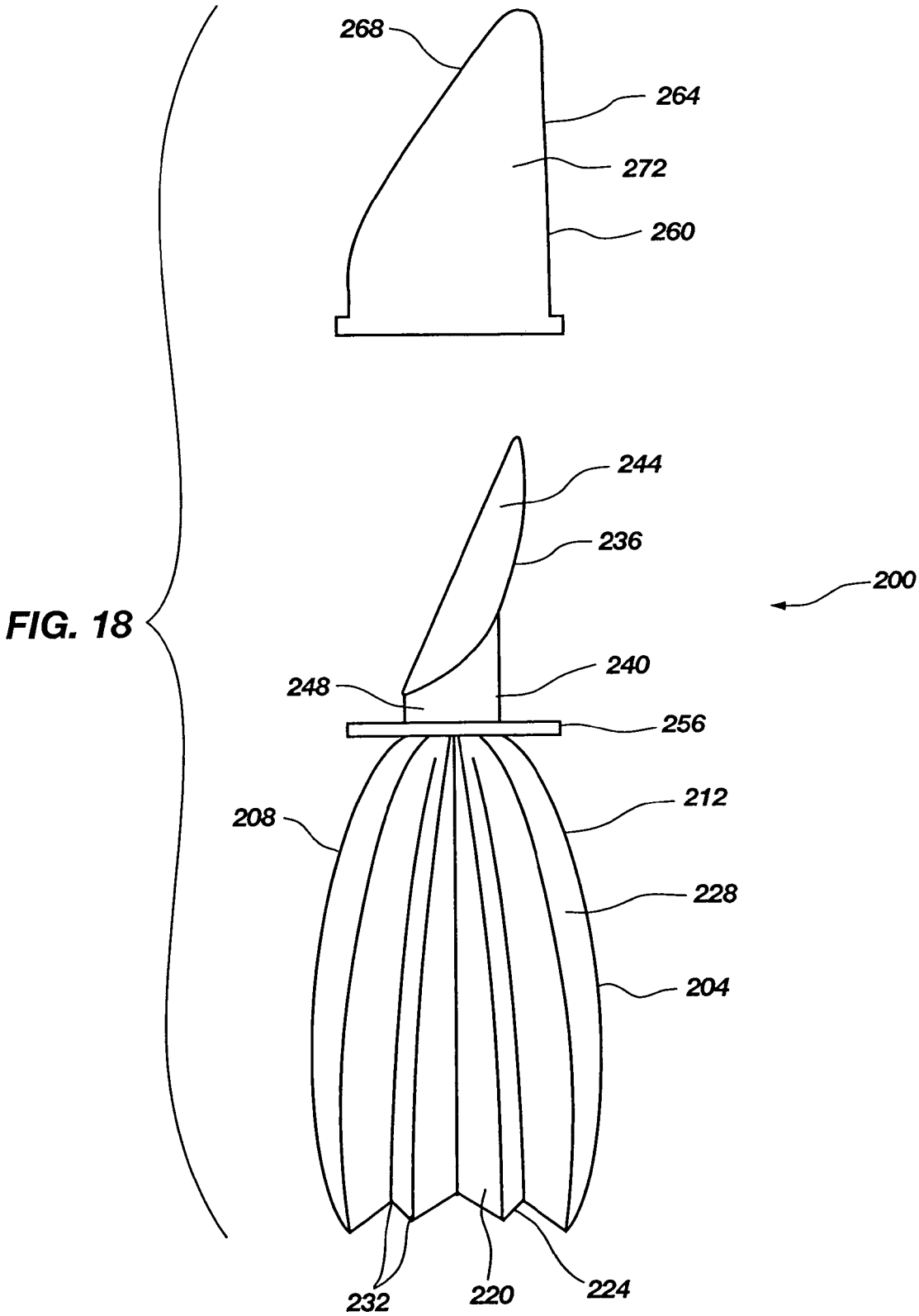
FIG. 18 shows an exploded side elevation view of the food delivery apparatus of FIG. 17.
Figure 19:
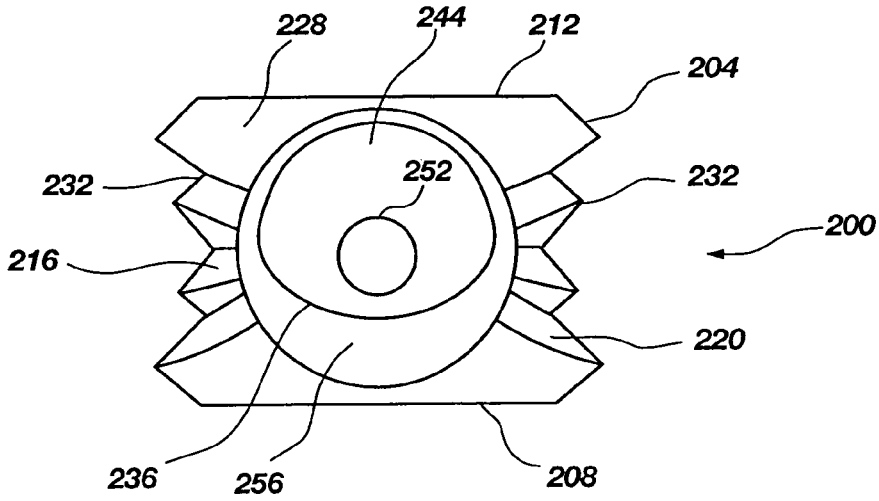
FIG. 19 shows a top view of the food delivery apparatus of FIG. 17.

FIGS. 17-19 show another illustrative food delivery apparatus according to the present invention. The food delivery apparatus 200 comprises a food container 204 comprising a front wall 208, a back wall 212, two side walls 216 and 220, and a bottom 224, which define a chamber 228 for holding the food. The side walls 216 and 220 and the bottom 224 are pleated in this illustrative embodiment. Further, the food container 204 is made of a flexible material, such as a flexible plastic, so that applying pressure to the front wall 208 and the back wall 212 causes the side walls 216 and 220 and the bottom 224 to bend at the pleats 232. This bending of the side walls 216 and 220 and the bottom 224 at the pleats results in a reduction of the volume contained in the chamber 228 and squeezing of the food out of the chamber 228.

Disposed on the food container 204 is a food utensil 236 comprising a neck 240 and a bowl 244. The neck 240 is hollow, thus defining a conduit 248, which is in open communication with the chamber 228 such that food squeezed out of the food container 204 enters the conduit 248. It will be appreciated that additional squeezing of food out of the chamber 228 causes additional food to move out of the chamber 228 into the conduit 248 and to push food through the conduit 248. The conduit 248 ends at an opening 252 in the bowl 244. Food that is pushed through the conduit 248 enters the bowl 244 through this opening 252. The illustrative embodiment of the invention shown in FIGS. 17-19 also contains a ring 256 disposed around the neck 240. This ring 256 prevents the bowl 244 from coming into contact with a table or other surface when the food delivery apparatus 200 is placed on such a table or other surface. Thus, the ring 256 assists in keeping the bowl 244 clean from contamination. The ring 256 also prevents a child from placing the bowl 244 too far into the mouth, and thus has a safety function. Further, the ring 256 prevents food from spilling from the opening 252 onto the front wall 208, back wall 212, or side walls 216 and 220.

The food container 204 and food utensil 236 can be molded as an integral unit such that the food container 204 and the food utensil 236 are made of the same material.

The food delivery apparatus 200 further comprises a cap 260 (FIGS. 17-18) configured for being placed over the bowl 244 and neck 240 for keeping these parts clean when not in use. The cap 260 comprises a side wall 264 and a top 268, which define a cavity 272 configured for receiving the bowl 244 and neck 240. The cap 260 can be made of a rigid material, such as a rigid plastic, such as polycarbonate.

Figure 20:
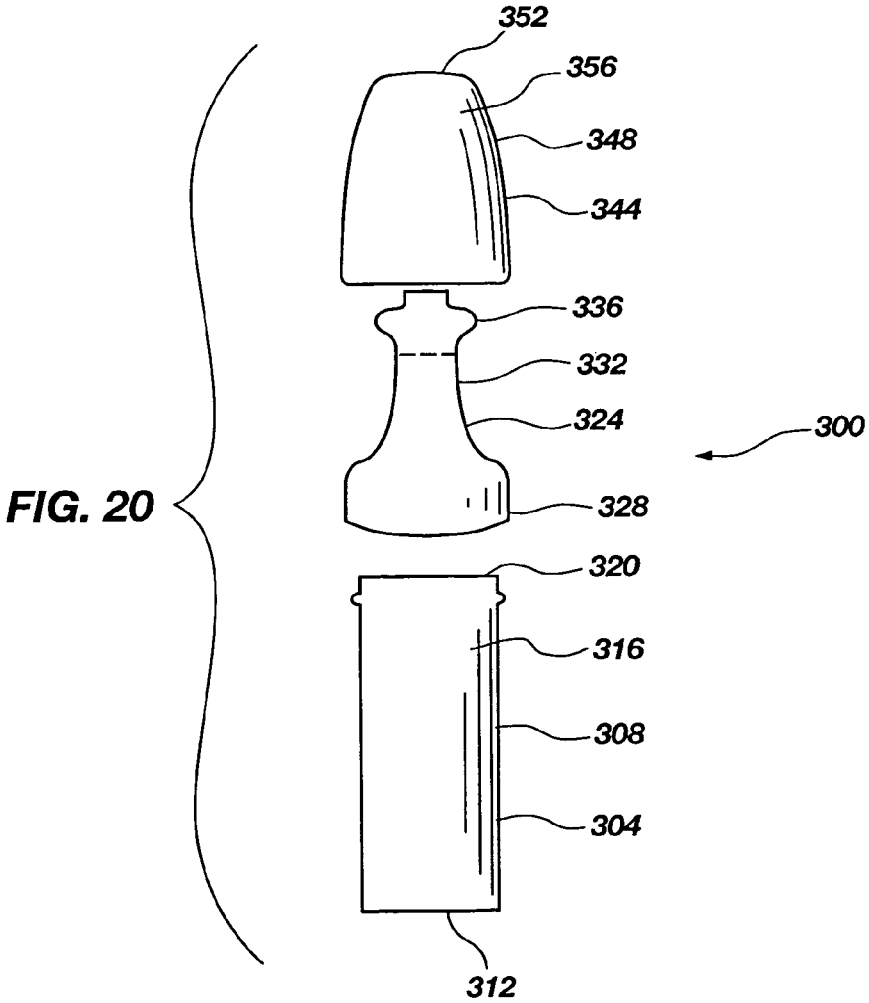
FIG. 20 shows an exploded front elevation view of an illustrative embodiment of a food delivery apparatus according to the present invention.

FIG. 20 shows another illustrative embodiment of a food delivery apparatus according to the present invention. This embodiment of the food delivery apparatus 300 comprises a food container 304 comprising a side wall 308 and a bottom 312, which define a chamber 316 for holding the food. The food container 304 includes an opening 320 through which the food can be transferred out of the food container 304.

Disposed on the food container 304 is a hollow food utensil 324 comprising a lower portion 328, a neck 332, and a lid 336. The lower portion 328 is configured to fit cooperatively over the opening 320 of the food container 304 to form a leak-proof seal. This leak-proof seal can be formed by any method known in the art, such as by heat sealing, by a twist seal, by an appropriate adhesive, and the like. The neck 332 and the lid 336 are separated from each other by a thin-walled section of the wall or break point 340.

The cap 344 comprises a wall 348 and a top 352 defining a chamber 356 configured for receiving the lid 336 and neck 332 of the food utensil 324.

Illustratively, the food is placed in the food container 304, and the food utensil 324 and cap 344 are put in place in the factory. The consumer uses the food delivery apparatus 300 by removing the cap 344, removing the lid 336 at the break point 340, adding water if needed, replacing the lid 336 and cap 344, mixing the contents of the food container 304, then removing the cap 344 and lid 336, and dispensing the food through the neck 332 for consumption.

Figure 21:
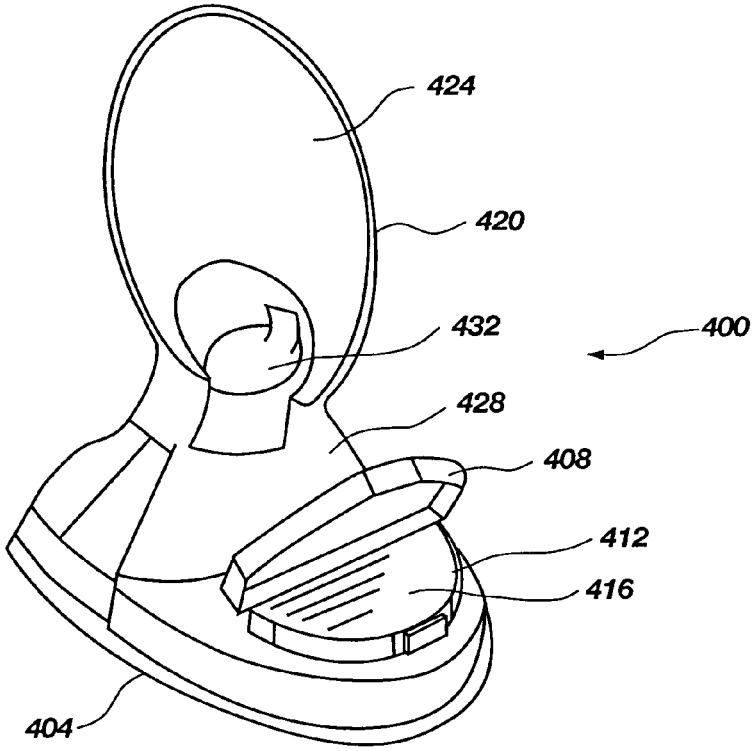
FIG. 21 shows a perspective cutaway view of an illustrative embodiment of a food delivery apparatus according to the present invention.

FIG. 21 shows another illustrative embodiment of a food delivery apparatus 400 according to the present invention. This embodiment comprises a base 404, which is attachable to a food container (not shown). The base comprises a fill door 408 configured for covering a fill port 412. In this embodiment, the fill port 412 is covered with a removable security seal 416. Disposed on the base 404 is a food utensil 420 comprising a bowl 424 and a neck 428. The neck is hollow such that food can flow from the food container to the neck 424, and from the neck 424 to the bowl 428. Across the opening of the neck 428 is another security seal 432.

This embodiment of the invention is used by opening the fill door 408, removing the security seal 416, and pouring water through the fill port 412. The fill door 408 is then closed, and water is mixed with the food in the food container. Next, the security seal 432 across the neck 428 of the food utensil 420 is removed, and food is squeezed out of the food container, through the neck 428, and into the bowl 424, where the food may be eaten by the consumer.

Figure 22:
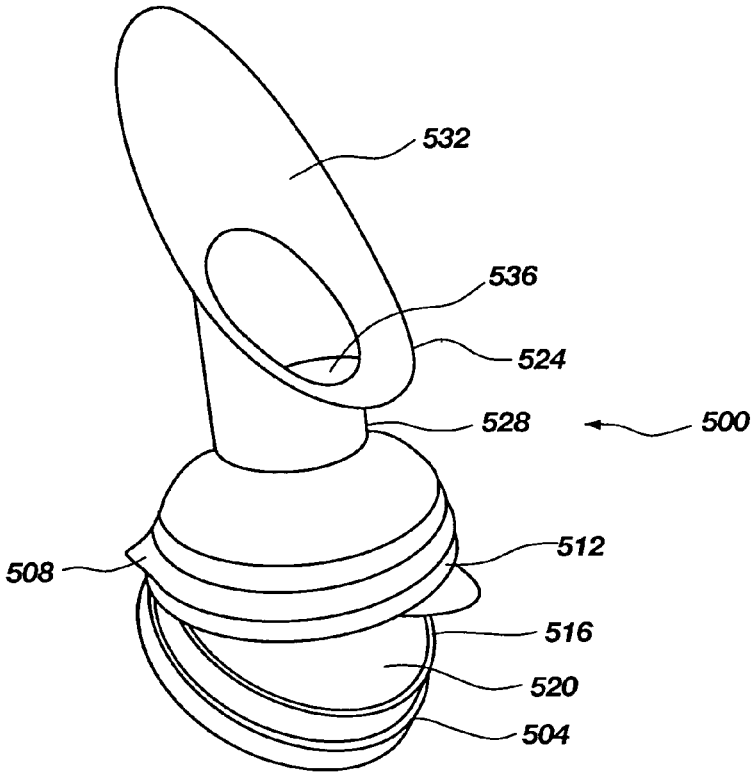
FIG. 22 shows a perspective view of an illustrative embodiment of a food delivery apparatus according to the present invention.

FIG. 22 shows another illustrative embodiment of the invention. This food delivery apparatus 500 comprises a cap base 504 connected by a hinge 508 to a cap top 512. The cap base comprises an opening 516, which is covered by a security seal 520. Disposed on the cap top 512 is a food utensil 524 comprising a hollow neck 528 on which is disposed a bowl 532. An anti-spill valve 536 is configured across the hollow neck to prevent spills of food.

This food delivery apparatus 500 is used by attaching the cap base 504 to a food container (not shown), which is filled with food at the factory. The consumer lifts the cap top 512 to reveal the security seal 520. The security seal 520 is removed, thus clearing the opening 516. Water can be poured through the opening 516, and then the cap top 512 is closed and the water is mixed with the food in the food container. The food is then squeezed out of the food container, through the cap base 504, through the cap top 512, through the neck 528, and into the bowl 532 where it available to be consumed.

The food delivery apparatus of the present invention can be made by injection molding, blow molding, and other techniques known in the art of molding plastic parts.

The subject matter claimed is:

1. A disposable food delivery apparatus comprising:

(a) a food container comprising a front wall, a back wall, two side walls, and a bottom, which define a chamber, which has a volume, for holding food, wherein the two side walls are pleated and wherein the food container comprises a flexible material such that applying pressure to the front wall and back wall results in bending of the two side walls along the pleats to thereby cause a reduction of the volume of the chamber, thereby squeezing food out of the chamber that may be contained therein; and (b) a food utensil disposed on the food container, wherein the food utensil comprises a hollow neck forming a conduit in open communication with the chamber such that food squeezed out of the food container enters the conduit, and a bowl disposed on the hollow neck;

wherein the food utensil is non-removably fixed with respect to the food container;

wherein the food delivery apparatus further comprises a ring disposed around the neck and a cap comprising a side wall and a top for defining a cavity configured for receiving the bowl and the neck, wherein the cap side wall defines a radially outward projecting step forming an abutment to contact the ring to limit movement of the cap on the food utensil.

2. The disposable food delivery apparatus of claim 1 wherein the bowl comprises an opening in communication with the conduit such that pushing food through the conduit causes food to pass through the opening and be received in the bowl.

3. The disposable food delivery apparatus of claim 1 wherein the food container and the food utensil are molded as an integral unit.

4. The disposable food delivery apparatus of claim 1 further comprising a cap comprising a side wall and a top for defining a cavity configured for receiving the bowl and the neck.

5. The disposable food delivery apparatus of claim 1 wherein the bottom is pleated such that when pressure is applied to the front wall and the back wall, the bottom bends along the pleats in the bottom to reduce a dimension of the bottom between the front wall and the back wall.

6. The disposable food delivery apparatus of claim 1 wherein the food utensil is positioned opposite the bottom.

7. The disposable food delivery apparatus of claim 1 wherein the front wall and the back wall are characterized by an absence of pleats.

8. A disposable food delivery apparatus comprising:

(a) a food container comprising a front wall, a back wall, two side walls, and a bottom, which define a chamber, which has a volume, for holding food, wherein the two side walls are pleated and wherein the food container comprises a flexible material such that applying pressure to the front wall and back wall results in bending of the two side walls along the pleats to thereby cause a reduction of the volume of the chamber, thereby squeezing food out of the chamber that may be contained therein; and (b) a food utensil disposed on the food container, wherein the food utensil comprises a hollow neck forming a conduit in open communication with the chamber such that food squeezed out of the food container enters the conduit, and a bowl disposed on the hollow neck;

wherein the food utensil is non-removably fixed with respect to the food container;

wherein the bottom is pleated such that when pressure is applied to the front wall and the back wall, the bottom bends along the pleats in the bottom to reduce a dimension of the bottom between the front wall and the back wall;

wherein the food utensil is positioned opposite the bottom;

wherein the front wall and the back wall are characterized by an absence of pleats;

wherein the bowl comprises an opening in communication with the conduit such that pushing food through the conduit causes food to pass through the opening and to be received in the bowl;

wherein the apparatus further comprises a ring disposed around the neck;

wherein the ring is disposed on an end of the food utensil closest to and in contact with the food container, and the ring comprises a substantially planar wall that projects in a radial direction from the neck and terminates in a free end in the radial direction;

wherein the food container and the food utensil are molded as an integral unit;

wherein at least one of the pleats on the side walls contacts the ring;

wherein the apparatus further comprises a cap comprising a side wall and a top for defining a cavity configured for receiving the bowl member and the neck;

wherein the cap side wall defines a radial projecting step extending toward an exterior of the cap forming an abutment to contact the ring to limit movement of the cap on the food utensil;

wherein the cap at the radial projecting step has a radial dimension that is greater than a radial dimension of a remainder of the cap.

9. A disposable food delivery apparatus comprising:

(a) a food container comprising a front wall, a back wall, two side walls, and a bottom, which define a chamber, which has a volume, for holding food, wherein the two side walls are pleated and wherein the food container comprises a flexible material such that applying pressure to the front wall and back wall results in bending of the two side walls along the pleats to thereby cause a reduction of the volume of the chamber, thereby squeezing food out of the chamber that may be contained therein; and (b) a food utensil disposed on the food container, wherein the food utensil comprises a hollow neck forming a conduit in open communication with the chamber such that food squeezed out of the food container enters the conduit, and a bowl or a tubular straw-like member disposed on the hollow neck;

wherein the food utensil further comprises a ring disposed around the neck;

wherein the ring is disposed on an end of the food utensil closest to and in contact with the food container, and the ring comprises a wall that projects in a radial direction from the neck and terminates in a free end in the radial direction;

wherein the disposable food delivery apparatus further comprises a cap comprising a side wall and a top for defining a cavity configured for receiving the bowl and the neck, wherein the cap side wall defines a radially outward projecting step forming an abutment to contact the ring to limit movement of the cap on the food utensil.

10. The disposable food delivery apparatus of claim 9 wherein the bottom is pleated such that when pressure is applied to the front wall and the back wall, the bottom bends along the pleats in the bottom to reduce a dimension of the bottom between the front wall and the back wall.

11. The disposable food delivery apparatus of claim 9 wherein the food utensil is positioned opposite the bottom.

12. The disposable food delivery apparatus of claim 9 wherein the front wall and the back wall are characterized by an absence of pleats.

13. A disposable food delivery apparatus comprising:

(a) a food container comprising a front wall, a back wall, two side walls, and a bottom, which define a chamber, which has a volume, for holding food, wherein the two side walls are pleated and wherein the food container comprises a flexible material such that applying pressure to the front wall and back wall results in bending of the two side walls along the pleats to thereby cause a reduction of the volume of the chamber, thereby squeezing food out of the chamber that may be contained therein; and (b) a food utensil disposed on the food container, wherein the food utensil comprises a hollow neck forming a conduit in open communication with the chamber such that food squeezed out of the food container enters the conduit, and a bowl or a tubular straw-like member disposed on the hollow neck; and (c) a cap comprising a side wall and a top for defining a cavity configured for receiving the bowl or tubular straw-like member and the neck;

wherein the cap side wall defines a radial projecting step extending toward an exterior of the cap forming an abutment to limit movement of the cap on the food utensil and wherein the food utensil further comprises a ring disposed around the neck, and wherein the radial projecting step of the cap contacts the ring to limit movement of the cap on the food utensil.

14. The disposable food delivery apparatus of claim 13 wherein the bottom is pleated such that when pressure is applied to the front wall and the back wall, the bottom bends along the pleats in the bottom to reduce a dimension of the bottom between the front wall and the back wall.

15. The disposable food delivery apparatus of claim 13 wherein the food utensil is positioned opposite the bottom.

16. The disposable food delivery apparatus of claim 13 wherein the front wall and the back wall are characterized by an absence of pleats.

17. A disposable food delivery apparatus comprising:

(a) a food container comprising a front wall, a back wall, two side walls, and a bottom, which define a chamber, which has a volume, for holding food, wherein the two side walls are pleated and wherein the food container comprises a flexible material such that applying pressure to the front wall and back wall results in bending of the two side walls along the pleats to thereby cause a reduction of the volume of the chamber, thereby squeezing food out of the chamber that may be contained therein; and (b) a food utensil disposed on the food container, wherein the food utensil comprises a hollow neck forming a conduit in open communication with the chamber such that food squeezed out of the food container enters the conduit, and a bowl or a tubular straw-like member disposed on the hollow neck; and (c) a cap comprising a side wall and a top for defining a cavity configured for receiving the bowl or tubular straw-like member and the neck;

wherein the cap side wall defines a radial projecting step extending toward an exterior of the cap forming an abutment to limit movement of the cap on the food utensil;

wherein the bottom is pleated such that when pressure is applied to the front wall and the back wall, the bottom bends along the pleats in the bottom to reduce a dimension of the bottom between the front wall and the back wall;

wherein the food utensil is positioned opposite the bottom;

wherein the front wall and the back wall are characterized by an absence of pleats;

wherein the bowl comprises an opening in communication with the conduit such that pushing food through the conduit causes food to pass through the opening and to be received in the bowl;

wherein the apparatus further comprises a ring disposed around the neck;

wherein the ring is disposed on an end of the food utensil closest to and in contact with the food container, and the ring comprises a wall that projects in a radial direction from the neck and terminates in a free end in the radial direction;

wherein the food container and the food utensil are molded as an integral unit;

wherein at least one of the pleats on the side walls contacts the ring;

wherein the cap at the radial projecting step has a radial dimension that is greater than a radial dimension of a remainder of the cap.

* * * * *